United States Patent [19]

Balistreri

[11] 4,385,731

[45] May 31, 1983

[54] APPARATUS FOR PRODUCING AND SEPARATING FINES OF A CRUSHABLE MATERIAL

[76] Inventor: Peter A. Balistreri, 1412 S. Park Ave., Buffalo, N.Y. 14220

[21] Appl. No.: 306,324

[22] Filed: Sep. 28, 1981

[51] Int. Cl.[3] ..... B02C 19/00

[52] U.S. Cl. ..... 241/79.1; 241/80; 241/152 A

[58] Field of Search ..... 241/79, 79.1, 80, 97, 241/30, 24, 152 A

[56] References Cited

U.S. PATENT DOCUMENTS

| | | | |
|---|---|---|---|
| 3,687,062 | 8/1972 | Frank | 241/79.1 X |
| 3,964,718 | 6/1976 | Balistrieri | 241/79 |
| 4,109,871 | 8/1978 | Lohnherr | 241/80 X |
| 4,187,989 | 2/1980 | McAleer et al. | 241/30 X |
| 4,354,641 | 10/1962 | Smith | 241/79.1 |

*Primary Examiner*—Mark Rosenbaum

*Attorney, Agent, or Firm*—Sommer & Sommer

[57] ABSTRACT

Apparatus for producing and separating crushable fines includes a crusher, an enclosure, an inclined vibratory chute, a conveyor, and a vent. Solid material is recycled through the crusher. Fines within the enclosure are agitated, become airborne, and are withdrawn and subsequently separated by filtration.

5 Claims, 2 Drawing Figures

APPARATUS FOR PRODUCING AND SEPARATING FINES OF A CRUSHABLE MATERIAL

BACKGROUND OF THE INVENTION

1. Field of the Invention

The present invention relates generally to the field of crushing apparatus, and more particularly to improved apparatus for producing and separating fines of a crushable material.

2. Description of the Prior Art

In recent years, there has been increased interest in the use of the fines of a crushable material. One example of this is the present research being conducted on fluidized bed combustion, employing the fines of coal.

Over the years, many different forms of crushers have been developed. One particular example of this is shown in my U.S. Pat. No. 3,964,718. While that patent discloses suitable apparatus for crushing a material, such material must be subjected to subsequent manipulative steps to produce and separate the usable fines thereof.

SUMMARY OF THE INVENTION

The present invention provides improved apparatus for producing and separating the fines of a crushable material.

The inventive apparatus broadly comprises: crushing means including a housing having an upper inlet and a lower outlet, a plurality of cooperative pairs of rotatable crush rollers arranged within the housing and spaced vertically therealong, the rollers of any one pair arranged closer to the outlet being more closely spaced than the rollers of any other pair arranged further from the outlet; an enclosure having an inclined bottom; an inclined chute arranged to receive material from the crusher outlet and extending downwardly into the enclosure; a vibrator or oscillator operatively arranged to selectively vibrate the chute; a conveyor operatively arranged to recycle material collecting in the bottom of the enclosure through the crusher; and vent means operatively arranged to permit withdrawal of airborne fines from within the enclosure.

Accordingly, the general object of the present invention is to provide improved apparatus for producing and separating usable fines of a crushable material.

Another object is to provide improved apparatus wherein oversized solids are recycled through the crusher.

Another object is to provide improved apparatus in which usable fines become entrained in the air within an enclosure, and may be easily separated by a conventional filtration technique.

These and other implicit objects and advantages will become apparent from the foregoing and ongoing written specification, the drawings, and the appended claims.

DESCRIPTION OF THE PREFERRED EMBODIMENTS

Figure 1:
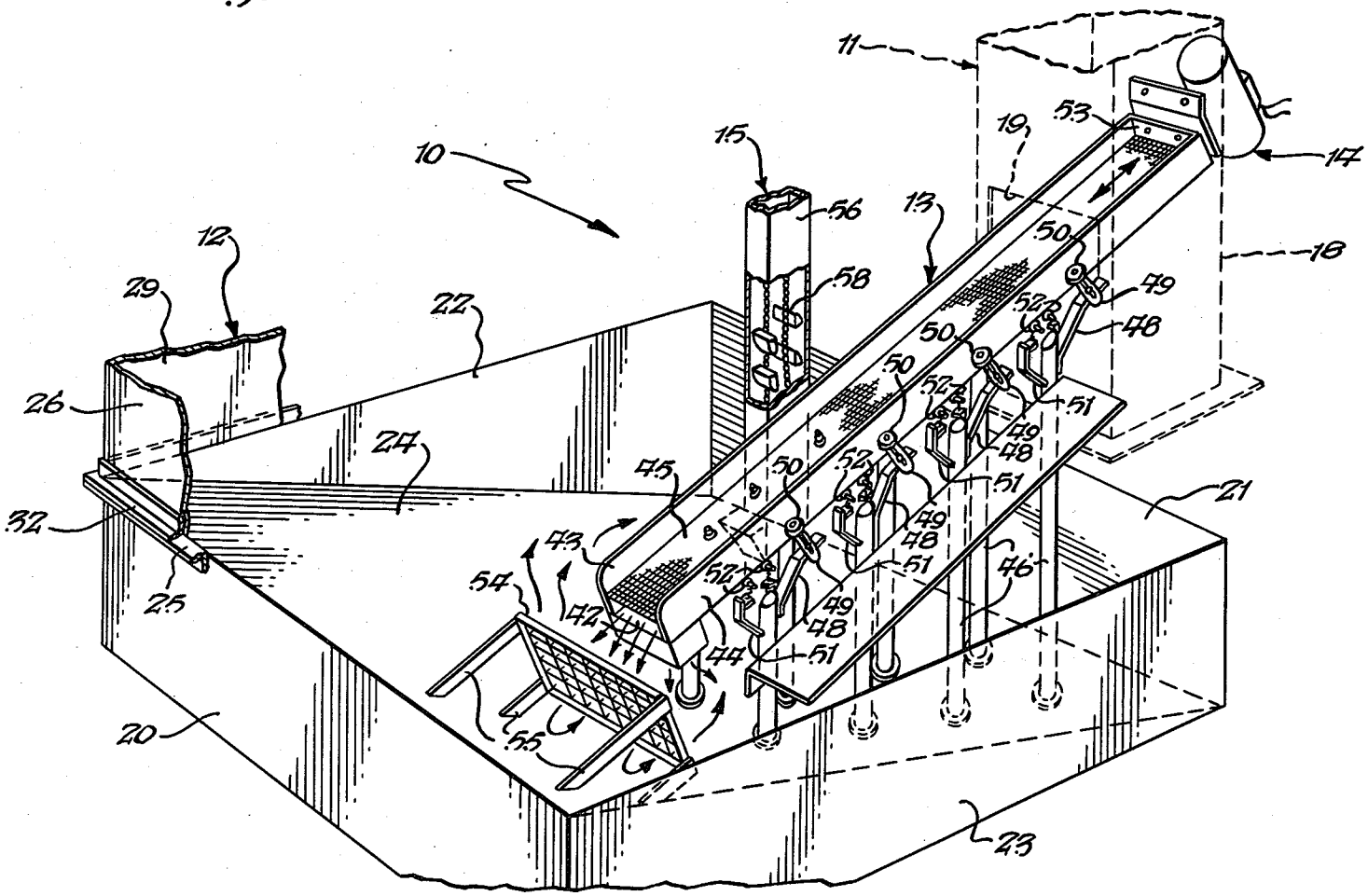
FIG. 1 is a fragmentary perspective view looking at the right front corner of the apparatus, with portions of the enclosing wall broken away to more clearly show the chute and the conveyor.

At the outset, it should be clearly understood that like reference numerals are intended to identify the same elements and/or structure consistently throughout the several drawing figures, as such elements and/or structure may be further described or explained by the entire written description of which this detailed description is an integral part.

Referring now to the drawings and more particularly to FIG. 1 thereof, the invention provides improved apparatus, of which the presently-preferred embodiment is generally indicated at 10, for producing and separating fines of a crushable material. As used herein, the term "crushable material" is intended to broadly identify any operative material which may be crushed, and specifically includes coal as one example thereof.

Figure 2:
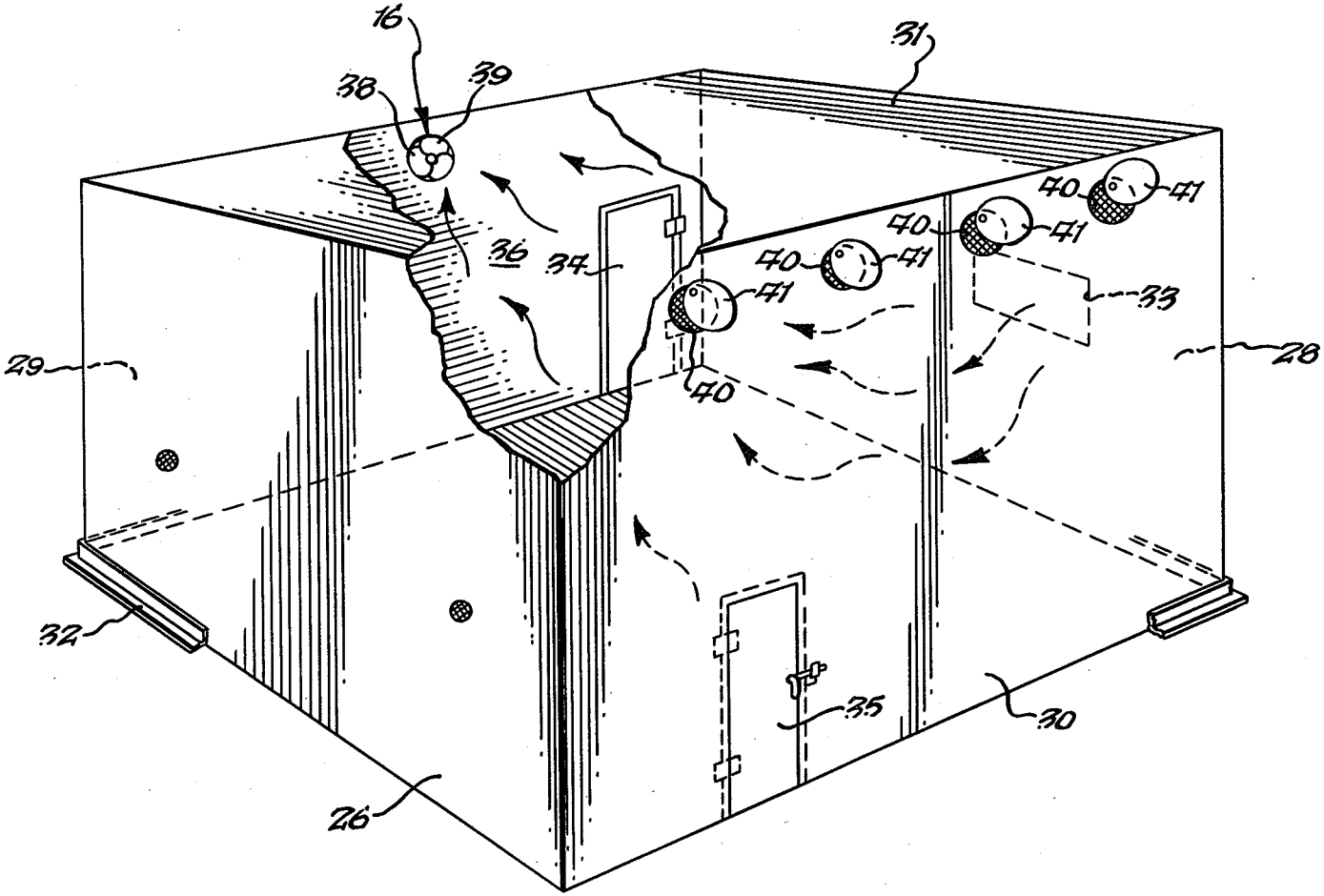
FIG. 2 is a fragmentary perspective view looking at the right front cover of the enclosure upper part.

The improved apparatus 10 is shown as generally including crushing means 11, an enclosure 12, an inclined chute 13, a vibrator 14, conveyor means 15, and vent means 16 (FIG. 2).

The crushing means 11 may be of the type disclosed in U.S. Pat. No. 3,964,718, the aggregate disclosure of which is hereby incorporated by reference. That apparatus 11 broadly includes a vertically-elongated housing 18, having a rectangular transverse cross-section, provided with an inlet opening (not shown) at its upper end and having an outlet opening 19 arranged proximate its lower end. A plurality of cooperative pairs of rotatable crush rollers (not shown) are arranged within housing 18. These cooperative pairs are vertically spaced from one another so that the horizontal spacing between the rollers of any particular pair progressively decreases in the direction of the outlet. The rollers may be driven by a chain (not shown) operatively arranged to cause the rollers of each cooperative pair to rotate in opposite directions so that material caught in the nip therebetween will be advanced downwardly toward the outlet. Thus, material admitted through the inlet moves downwardly, is sequentially crushed by the progressively closer rollers of each successive pair, and exits through the outlet opening 19. Additional details as to the structure and operation of this crushing apparatus may be found in the aforesaid U.S. Pat. No. 3,964,718. Of course, the particular species is only one example of such a crusher. If desired, other forms of crushers may be readily substituted therefor.

The enclosure 12 is shown as having a lower part (FIG. 1) and an upper part (FIG. 2). The lower part has planar vertical front and rear walls 20, 21, and planar vertical left and right side walls 22, 23. The lower part also has a downwardly and rearwardly inclined planar bottom 24, which extends from the upper margin of the front wall downwardly and rearwardly to the lower margin of the rear wall. Of course, the perimetrical margin of the bottom 24 is suitably secured, as by welding or suitable fasteners, to the front, rear and side walls. The upper margin of the housing lower part is shown as being further provided with an out-turned perimetrical mounting flange 25.

As best shown in FIG. 2, the housing upper part is an inverted rectangular somewhat box-like enclosure. Specifically the upper part includes planar vertical front and rear walls 26, 28, planar vertical left and right side walls 29, 30, and a planar horizontal top 31. The lower margin of the housing upper part is provided with a perimetrical out-turned mounting flange 32, which is adapted to rest on and be suitably secured to lower part flange 25, as shown in FIG. 1. Upper part rear wall 28 is provided with a rectangular opening 33 to accommodate passage of the chute. The upper part left and right walls are shown provided with optional doors 34, 35, through which access to the enclosed chamber 36 therewithin may be had. Left wall 29 is provided with an elevated vent opening 38 in which an exhaust fan 39 is mounted. The right wall 30 is provided with a plurality of horizontally-spaced elevated openings, severally indicated at 40. Each of these openings is screened and adapted to be selectively closed by a cover 41 pivotally mounted on the right wall. Thus, the housing upper and lower parts are assembled together to define enclosure 36 therewithin.

Adverting now to FIG. 1, an inclined chute 13 has its upper end arranged to receive material from crusher 11, passes through crusher outlet opening 19 and housing upper part opening 33, and extends downwardly toward lower part front panel 20. Thus chute 13 has a somewhat U-shaped transverse cross-section, formed by a planar bottom 42 and leftward and right side walls 43, 44 extending upwardly therefrom. If desired, the chute may further include a screen 45 which is parallel to but spaced from the bottom 42. The chute is supported by a plurality of posts 46 extending upwardly from bottom 24. An arm 48 extends outwardly from the upper end of each post, and supports a second arm 49 provided with a distal roller 50 engaging the sides of the chute. Third arms 51 also extend outwardly from the posts and support roller members 52 which engage the bottom of the chute. Thus, the chute is mounted on the posts for vibratory movement along the chute's downwardly and forwardly inclined axis of elogation.

The vibrator 14, which may be of the eccentric drive type, is mounted on a transverse end plate 53 closing the upper end of the chute. This particular vibrator may be selectively operated to shake or oscillate the chute to and from along its axis of elongation. However, other forms of vibrators or oscillators may be readily substituted, and the direction of oscillation or shaking is not deemed to be critical.

The preferred embodiment is also shown provided with an optional screen-like abutment plate 54, mounted on the enclosure bottom 24 by four legs, severally indicated at 55. This abutment plate is spaced from the lower end of the chute, but transverse of its axis of elongation, so that solid material hurled from the lower end of the chute will impinge and impact against the abutment screen.

The conveyor means 15 includes a vertically-elongated tubular housing 56, having a rectangular transverse cross-section, within which a bucket conveyor 58 is operatively mounted. The lower end of conveyor housing 56 is adjacent the lower part rear wall 21, and is provided with one or more openings so that material moving downwardly and rearwardly along bottom 24 may enter housing 56 and be elevated by the buckets of conveyor 58. The upper end (not shown) of the bucket conveyor is arranged to discharge into the inlet (not shown) of the crusher so that the material carried by the conveyor buckets will be recycled through the crush rollers. In this regard, the enclosure bottom may have a compound inclination, or some other shape, to direct the solid material to the mouth of the conveyor. If desired, the improved apparatus may be further provided with one or more fluid-discharging nozzles (not shown) operatively arranged to agitate the material within the enclosure so that the air within the enclosure will be richly entrained with fines thereof. For example, these nozzles may be mounted on the bottom of the chute so as to discharge an air jet upwardly through screen 45, thereby causing the fines to become airborne. Of course, the nozzles, wherever positioned, are operatively supplied with such fluid from a suitable source, such as an air compressor (not shown).

Such air-entrained fines are withdrawn through vent opening 16. If desired, one or all of opposite openings 40 may be selectively opened to facilitate a flow through the enclosure and outwardly through outlet 38. Of course, the fines in the air exiting the enclosure through outlet 38, are separated by suitable apparatus (not shown), such as a bank of filter bags or the like.

The enclosure preferably joins the crusher so that the chamber 36 is substantially sealed, save for the deliberately provided openings.

Thus, in operation, crushable material, such as coal, is supplied to inlet of the crusher. Such material is ground or crushed progressively finer as it passed downwardly therethrough. The crushed material then falls down the chute, where it is agitated by vibrator 14 and the air jets (if provided). Such agitation tends to create airborne fines, with the heavier solids being directed downwardly to the bucket conveyor. The conveyor functions to recycle the solids back through the crusher, along with the addition of any added fresh material to be ground. The fines become entrained in air within the enclosure, are withdrawn through outlet 38, and are subsequently separated by a conventional filtration technique. Thus, the inventive apparatus functions to produce and separate fines of a crushable material.

Of course, many modifications may be made. The particular material of which the various parts and components are constructed, is not deemed critical, and may be readily changed. If desired, the conveyor can be provided in a corner of the enclosure with the enclosure bottom thereof being appropriately shaped or sloped to direct solids thereto. The enclosure may be of unitary or of sectional construction. Different types of crushers may be substituted for the specific form shown and described herein. Similarly, other forms of chutes, screens and vibrators may be substituted.

Therefore, while the presently preferred embodiment has been shown and described, persons skilled in this art will appreciate that various additional changes and modifications may be made without departing from the spirit of the invention, as defined by the following claims.

What is claimed is:

1. Apparatus for producing and separating fines of a crushable material, comprising:

crushing means including a housing having an upper inlet and a lower outlet, and including means for crushing material passing from said inlet toward said outlet;

an enclosure having an inclined bottom;

an inclined chute arranged to receive material from said outlet and extending into said enclosure;

a vibrator operatively arranged to selectively vibrate said chute;

conveyor means operatively arranged to convey material accumulating on the bottom of said enclosure to said inlet;

pneumatic means operatively arranged to supply an upward flow of air through the bottom of said enclosure to increase the quantity of airborne fines within said enclosure; and vent means operatively arranged to permit withdrawal of airborne fines of said material from said enclosure.

2. The apparatus as set forth in claim 1 and further comprising an abutment screen mounted on said enclosure and aligned with the discharge end of said chute.

3. The apparatus as set forth in claim 1 wherein said conveyor means is a bucket conveyor.

4. The apparatus as set forth in claim 1 wherein the bottom of said chute is a screen.

5. The apparatus as set forth in claim 1 wherein said vent means includes a variable opening through said enclosure above the bottom thereof.

* * * * *